US009472856B2

(12) United States Patent
Yano

(10) Patent No.: US 9,472,856 B2
(45) Date of Patent: Oct. 18, 2016

(54) ANTENNA

(71) Applicant: Furuno Electric Co., Ltd., Nishinomiya (JP)

(72) Inventor: Kohji Yano, Nishinomiya (JP)

(73) Assignee: Furuno Electric Co., Ltd., Nishinomiya (JP)

( * ) Notice: Subject to any disclaimer, the term of this patent is extended or adjusted under 35 U.S.C. 154(b) by 90 days.

(21) Appl. No.: 14/390,371

(22) PCT Filed: Apr. 1, 2013

(86) PCT No.: PCT/JP2013/059845

§ 371 (c)(1),
(2) Date: Oct. 2, 2014

(87) PCT Pub. No.: WO2013/150996

PCT Pub. Date: Oct. 10, 2013

(65) Prior Publication Data

US 2015/0061956 A1 Mar. 5, 2015

(30) Foreign Application Priority Data

Apr. 2, 2012 (JP) ..... 2012-084035

(51) Int. Cl.
*H01Q 13/10* (2006.01)
*H01Q 19/19* (2006.01)
(Continued)

(52) U.S. Cl.
CPC ..... *H01Q 19/193* (2013.01); *H01Q 15/16* (2013.01); *H01Q 19/134* (2013.01); *H01Q 21/08* (2013.01); *H01Q 21/24* (2013.01)

(58) Field of Classification Search
CPC .... H01Q 19/193; H01Q 15/14; H01Q 21/24; H01Q 21/08; H01Q 15/16; H01Q 19/134
USPC ..... 343/781 CA, 912, 781 P
See application file for complete search history.

(56) References Cited

U.S. PATENT DOCUMENTS 5,392,155 A * 2/1995 Tamari ..... G02B 27/58 343/912
5,959,590 A * 9/1999 Sanford ..... H01Q 19/021 343/781 CA

FOREIGN PATENT DOCUMENTS

CN 1075828 A 9/1993
CN 2156591 Y 2/1994
(Continued)

OTHER PUBLICATIONS

European Patent Office, Extended European Search Report Issued in Application No. 13772993-5, Sep. 9, 2015, Germany, 5 pages.

*Primary Examiner* — Dieu H Duong
(74) *Attorney, Agent, or Firm* — Alleman Hall McCoy Russell & Tuttle LLP

(57) ABSTRACT

A compact antenna that includes a power feeding waveguide, a sub reflection mirror, and a main reflection mirror. Radio waves comprised of a vertical polarized wave and a horizontal polarized wave are transmitted to the power feeding waveguide. The sub reflection mirror is disposed to face an opening of the power feeding waveguide and reflects the radio wave radiated from the opening. The main reflection mirror is disposed to face the sub reflection mirror and outwardly radiates the radio wave reflected by the sub reflection mirror. A front surface of the main reflection mirror has a shape formed by rotating a line reaching one side and the other side of a predetermined parabola curve at least once, around a rotational axis. A front surface of the sub reflection mirror has a shape formed by rotating either one of a stepped line and a wavy line around the rotational axis.

10 Claims, 5 Drawing Sheets

(51) Int. Cl.

| | |
|---|---|
| ***H01Q 21/24*** | (2006.01) |
| ***H01Q 15/16*** | (2006.01) |
| ***H01Q 19/13*** | (2006.01) |
| ***H01Q 21/08*** | (2006.01) |

(56) References Cited

FOREIGN PATENT DOCUMENTS

| | | | |
|---|---|---|---|
| CN | 1026741 | C | 11/1994 |
| CN | 101976766 | A | 2/2011 |
| CN | 102244320 | A | 11/2011 |
| GB | 1218351 | A | 1/1971 |
| JP | 248804 | A | 2/1990 |
| JP | 5152835 | A | 6/1993 |
| JP | 5275920 | A | 10/1993 |
| JP | H05275920 | A | 10/1993 |
| JP | 628818 | Y2 | 8/1994 |
| JP | 888512 | A | 4/1996 |
| JP | 9199924 | A | 7/1997 |
| JP | H1127036 | A | 1/1999 |
| JP | 2002198730 | A | 7/2002 |
| JP | 2011239281 | A | 11/2011 |
| WO | 2005018049 | A1 | 2/2005 |
| WO | 2011101471 | A1 | 8/2011 |

* cited by examiner

ANTENNA

TECHNICAL FIELD

This disclosure relates to an antenna, which includes a main reflection mirror and a sub reflection mirror.

BACKGROUND ART

Conventionally, for satellite communication and meteorological observation, antennas (parabola antennas) having a parabolic reflector are used in some cases. Patent Document 1 discloses such parabola antenna.

The parabola antenna of Patent Document 1 includes a power feeding waveguide, a horn, a parabola reflector, and a reflective plate. A radio wave to be outwardly radiated is transmitted through the power feeding waveguide and radiated from the horn toward the parabola reflector. The horn is disposed at a focal point of a parabolic surface of the parabola reflector and, therefore, the parabola reflector reflects this radio wave as a planar wave. Moreover, the reflective plate is disposed to cancel the reflection on the horn caused by the parabola reflector or the power feeding waveguide. Note that, this reflective plate is formed into a stepped shape.

Thus, Patent Document 1 has a configuration in which the radio wave radiated from the horn is reflected on the parabola reflector to outwardly radiate the radio wave (a configuration having a single reflector). On the other hand, Patent Document 2 discloses a configuration having two reflectors.

An antenna device of Patent Document 2 uses a reflective plate (a sub reflection mirror) to reflect a radio wave radiated by a primary radiator and then uses a lens antenna (or a parabola antenna, a main reflection mirror) to further reflect the radio wave, so as to outwardly radiate the radio wave. Note that, this reflective plate has a configuration of which shape can be changed and a fixed beam pattern can be maintained even if a scanning angle is changed.

REFERENCE DOCUMENTS OF CONVENTIONAL ART

Patent Document(s)

Patent Document 1: JPH06-028818Y
Patent Document 2: JPH11-027036A

DISCLOSURE OF THE INVENTION

Problems to be Solved by the Invention

Meanwhile, when using a parabola antenna for meteorological observation, there is a case where many parabola antennas having small apertures are disposed to perform the observation. However, it is known that directivity degrades if the apertures of the parabola antennas are set small, and moreover, when using dual polarized waves, the two polarized waves may be mixed.

Moreover, with the configuration including the horn as the parabola antenna of Patent Document 1, a radiation port needs to be disposed at the focal position of the parabola radiator (parabola curve) and, therefore, it is difficult to reduce a size of the parabola antenna in a direction orthogonal to an aperture thereof.

This disclosure is made in view of the above situations and aims to provide an antenna, which has a small-sized configuration without degrading an antenna property.

Summary and Effect(s) of the Invention

Problems to be solved by the present disclosure are described above, and means for solving the problems and effects thereof will be described below.

According to one aspect of this disclosure, an antenna with the following configuration is provided. That is, the antenna includes a power feeding waveguide, a sub reflection mirror, and a main reflection mirror. Radio waves including a vertical polarized wave and a horizontal polarized wave are transmitted to the power feeding waveguide. The sub reflection mirror is disposed to face an opening of the power feeding waveguide and reflects the radio waves radiated from the opening. The main reflection mirror is disposed to face the sub reflection mirror and outwardly radiates the radio waves reflected by the sub reflection mirror. A front surface of the main reflection mirror has a shape formed by rotating a line reaching one side and the other side of a predetermined parabola curve at least once, around a rotational axis. A front surface of the sub reflection mirror has a shape formed by rotating either one of a stepped line and a wavy line around the rotational axis.

Thereby, even if an aperture of the antenna are small, a planar wave can be outwardly radiated with satisfactory antenna property. Further, since the antenna has a configuration provided with the sub reflection mirror, the size thereof in a direction orthogonal to an aperture diameter can be reduced. Therefore, an antenna that is small in size as a whole and has the satisfactory antenna property can be achieved.

In the antenna, the front surface of the main reflection mirror preferably has a shape formed by rotating a line intersecting with the predetermined parabola curve at least twice, around the rotational axis.

Thereby, the antenna having more satisfactory antenna property can be achieved.

In the antenna, the front surface of the main reflection mirror preferably has a shape formed by rotating a line of which inclination changes continuously instead of discretely, around the rotational axis.

Thereby, the antenna having more satisfactory antenna property can be achieved.

In the antenna, the front surface of the sub reflection mirror preferably has the shape formed by rotating the stepped line around the rotational axis.

Thereby, a sub reflection mirror that can be manufactured with a simple method can be achieved.

The antenna is preferably used for observing a meteorological status.

Specifically, since there is a case where a plurality of parabola antennas having small aperture diameters are disposed to perform meteorological observation, the effects of this disclosure that an antenna with a small-sized configuration is achieved without degrading the antenna property can be exerted further favorably.

MODE(S) FOR CARRYING OUT THE INVENTION

Figure 1:
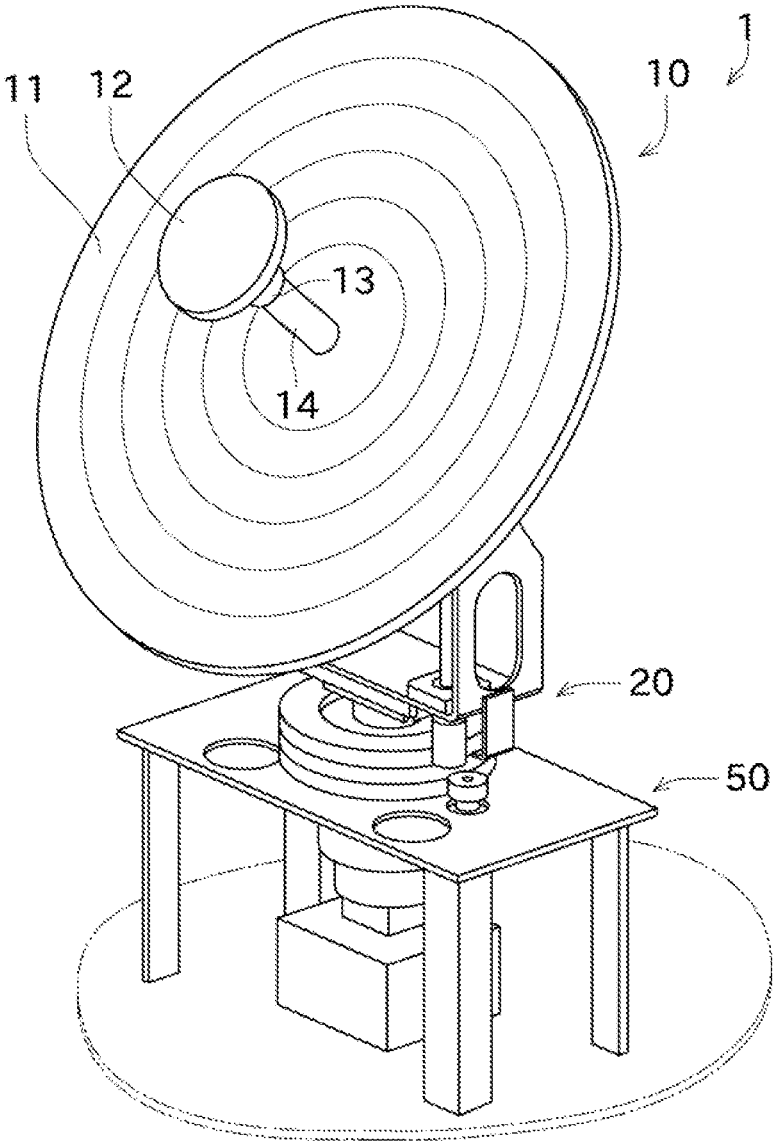
FIG. 1 is a perspective view illustrating an antenna device according to one embodiment of this disclosure.
Figure 2:
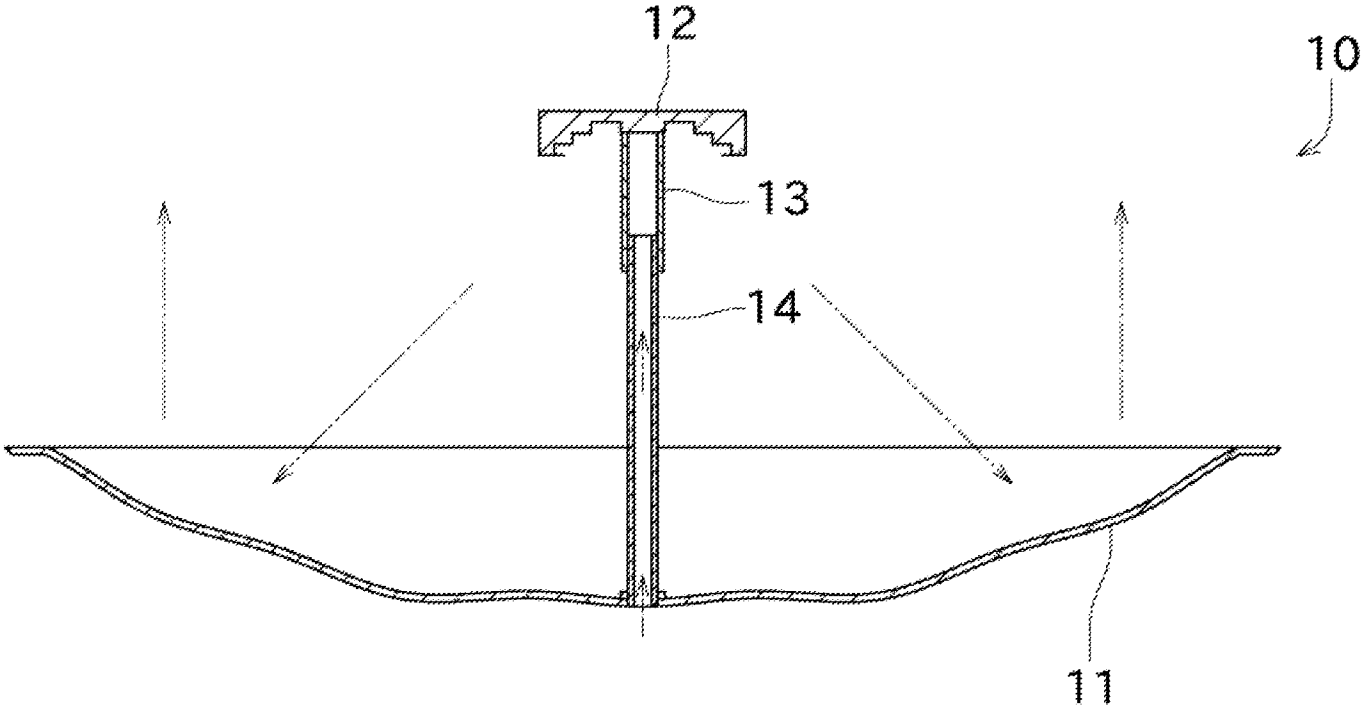
FIG. 2 is a cross-sectional view of an antenna.

Next, one embodiment of this disclosure is described with reference to the drawings. FIG. 1 is a perspective view illustrating an antenna device 1 according to one embodiment of this disclosure. FIG. 2 is a cross-sectional view of an antenna 10.

The antenna device 1 configures a radar apparatus along with a non-illustrated radio wave generator (e.g., a magnetron), a controller and the like. The antenna device 1 is used, for example, for meteorological observation; however, it can also be used for other applications (e.g., communication).

As illustrated in FIG. 1, the antenna device 1 includes the antenna 10, a transmission part 20, and a pedestal 50. The antenna 10 is configured to be rotatable in vertical directions (directions of changing an elevation angle) and horizontal directions (directions of changing an azimuth).

The pedestal 50 includes legs and a supporting plate fixed to the legs. Respective components (e.g., gears and a waveguide) configuring the transmission part 20 are attached to this supporting plate. Further, a motor (not illustrated) configured to rotate the antenna 10 in the vertical directions and a motor (not illustrated) configured to rotate the antenna 10 in the horizontal directions are attached to this pedestal 50.

The transmission part 20 can rotate the antenna 10 in the vertical and horizontal directions by using the gears and the like to transmit powers of these motors.

Moreover, the transmission part 20 includes a non-illustrated waveguide configured to transmit, to the antenna 10, the radio wave (electromagnetic wave) generated by the radio wave generator. Here, in this embodiment, both vertical polarized wave and horizontal polarized wave are transmitted to the antenna 10.

As illustrated in FIGS. 1 and 2, the antenna 10 includes a main reflection mirror 11, a sub reflection mirror 12, a sub reflection mirror supporting part 13, and a power feeding waveguide 14.

The power feeding waveguide 14 is connected with the waveguide of the transmission part 20. The power feeding waveguide 14 is a circular cylindrical member, and a central axial line thereof is disposed to coincide with central axial lines of the main and sub reflection mirrors 11 and 12. As illustrated in FIG. 2, the radio wave transmitted inside the power feeding waveguide 14 is radiated to spread from an opening of the power feeding waveguide 14.

The sub reflection mirror supporting part 13 is a circular cylindrical member attached to an outer circumferential part of the power feeding waveguide 14. The sub reflection mirror supporting part 13 supports the sub reflection mirror 12. Moreover, the sub reflection mirror supporting part 13 is made of a material with high transmittance for radio waves.

The sub reflection mirror 12 is disposed to face the opening of the power feeding waveguide 14. The sub reflection mirror 12 is made of a material with high reflectance for radio waves. The sub reflection mirror 12 has a shape formed by concentrically forming a plurality of steps in a circular cylinder (described later in detail). The sub reflection mirror 12 reflects the radio wave radiated from the opening of the power feeding waveguide 14 toward the main reflection mirror 11.

The main reflection mirror 11 is disposed to face the sub reflection mirror supporting part 13. The main reflection mirror 11, similar to the sub reflection mirror 12, is made of a material with high reflectance for radio waves. A front surface of the main reflection mirror 11 is a curved surface that is approximated to a parabolic surface (described later in detail). The main reflection mirror 11 reflects the radio wave radiated from the sub reflection mirror 12. Thus, a plane wave can be outwardly radiated. Note that, a shape of the main reflection mirror 11 is described later in detail.

The radio wave radiated by the main reflection mirror 11 reflects on, for example, rain or cloud. This reflection wave is transmitted in the reverse flow inside the path of the radio wave described above. Then, for example, the controller of the radar apparatus analyzes this reflection wave and, thus, the antenna device 1 can obtain position, size, and density of water droplet.

Moreover, by performing the dual polarization as this embodiment, a precipitation intensity can be obtained based on, for example, a difference in reflectance between the two kinds of radio waves. With a meteorological radar, the meteorological observation is performed as described above.

Figure 3:
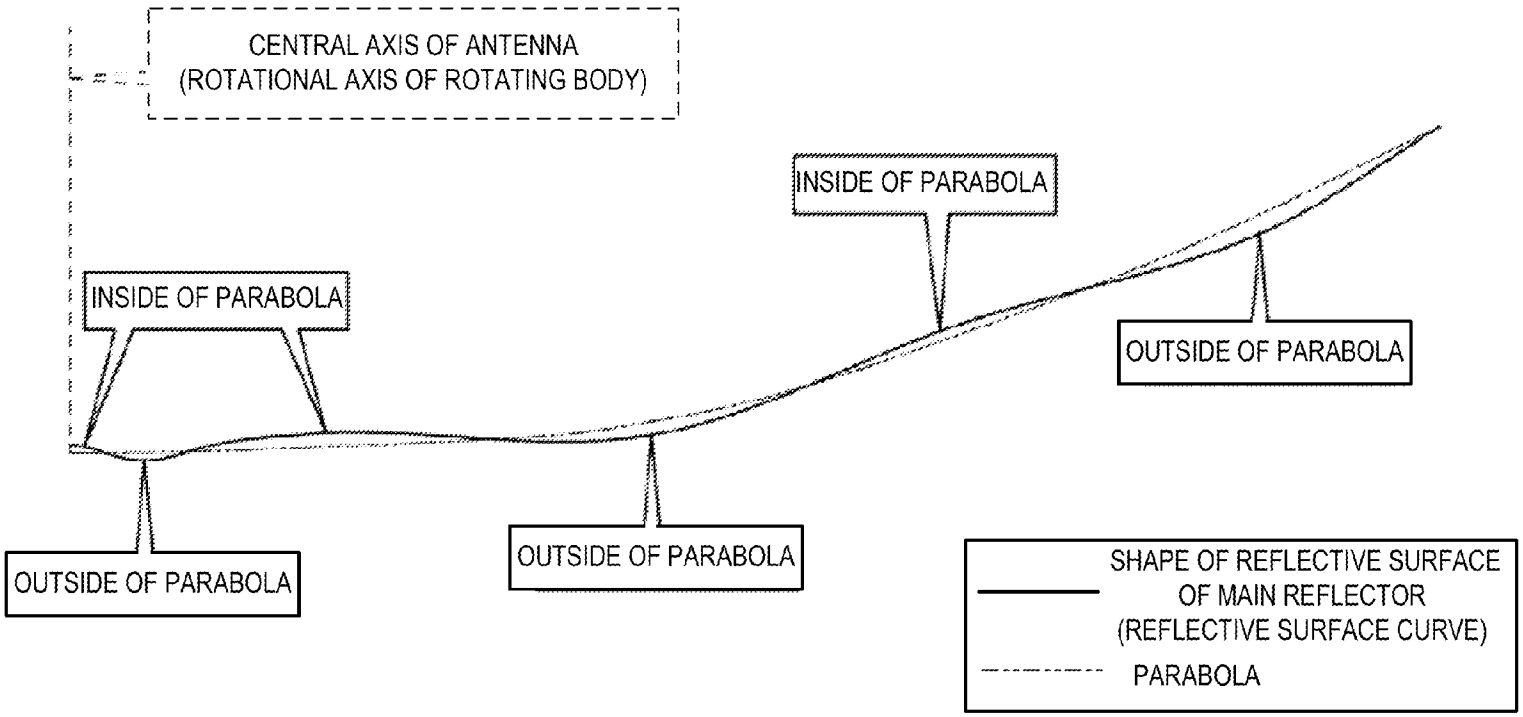
FIG. 3 is a view for describing a shape of a reflective surface of a main reflection mirror.

Next, the shapes of the main and sub reflection mirrors 11 and 12 are described with reference to FIGS. 2 and 3. FIG. 3 is a view for describing a shape of a reflective surface of the main reflection mirror 11. Hereinafter, surfaces of the main and sub reflection mirrors 11 and 12 on the side reflecting the radio wave are referred to as the reflective surfaces.

Since the main and sub reflection mirrors 11 and 12 utilize the dual polarized waves in this embodiment, the reflective surfaces of the main and sub reflection mirrors 11 and 12 have axially symmetric shapes. In other words, the reflective surfaces of the main and sub reflection mirrors 11 and 12 have shapes (rotary surface) that can be formed by rotating predetermined lines around a predetermined rotational axis, respectively.

Reflective surfaces of the conventional sub reflection mirrors have circular shapes with almost no concave nor convex. On the other hand, the reflective surface of the sub reflection mirror 12 of this embodiment has a shape concentrically formed with a plurality of steps. More specifically, the reflective surface of the sub reflection mirror 12 has a shape formed by rotating a stepped (pulse-shaped) line.

Moreover, reflective surfaces of the conventional main reflection mirrors are parabolic. On the other hand, the reflective surface of the main reflection mirror 11 of this embodiment is a curved surface formed by slightly deforming a parabolic surface, which is described in detail below.

As illustrated in FIG. 3, the reflective surface of the main reflection mirror 11 has a shape formed by rotating a curve (hereinafter, the reflective surface curve) around the predetermined rotational axis. This reflective surface curve intersects with a parabola several times. More specifically, the reflective surface curve, compared to a predetermined parabola curve, is located inward (one side, upper side) of the parabola curve at the rotational axis. Then, the reflective surface curve is located outward (the other side, lower side), inward, outward, inward, and outward of this parabola curve in this order as going farther from this rotational axis.

Figure 4A:
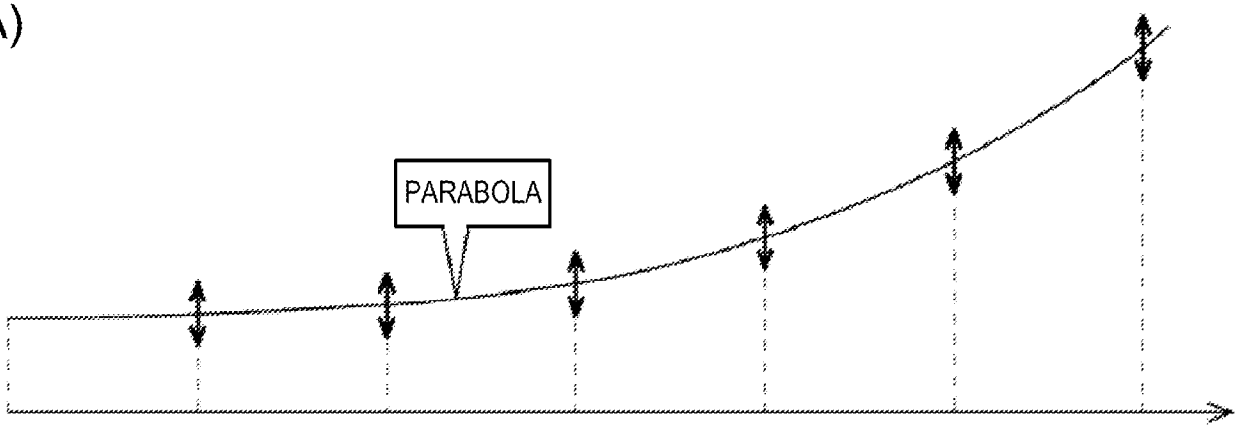
FIGS. 4(*a*) and 4(*b*) show views for describing processing of determining a shape of the reflective surface of the main reflection mirror.
Figure 4B:
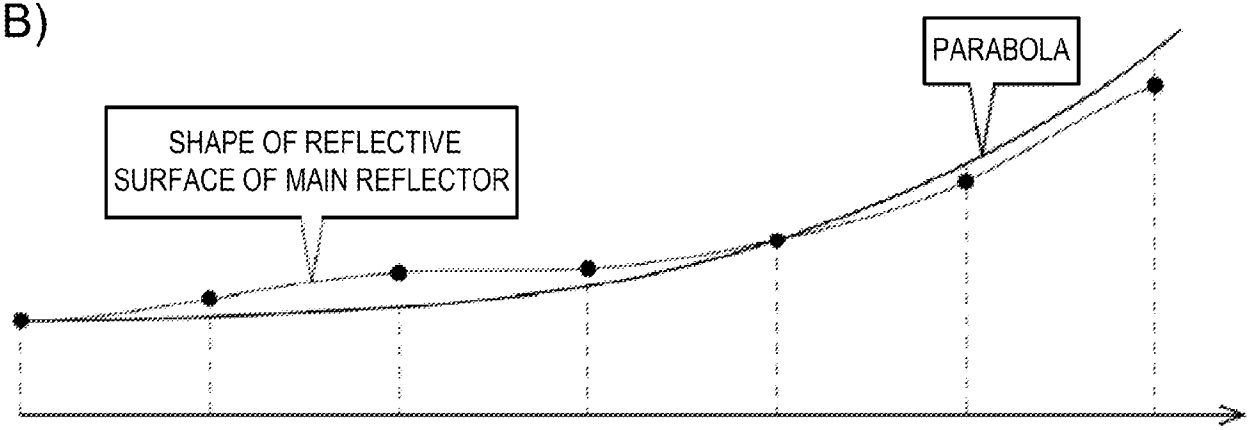

Next, processing of obtaining the specific shape of the reflective surface is briefly described with reference to FIGS. 4(*a*) and 4 (*b*). FIGS. 4(*a*) and 4(*b*) show views for describing processing of determining the shape of the reflective surface of the main reflection mirror 11.

The reflective surface curve is determined as follows. Specifically, the parabola curve to serve as a base is set first. Then, reference points are set on the parabola curve at a predetermined interval at positions shifted upward or downward from the parabola curve. Further, a reflective surface curve is temporarily set by, for example, multi-term approximation based on the plurality of set reference points.

Next, an antenna property is evaluated through, for example, simulation on this reflective surface curve, and the reference points are set again as needed. Then, by repeating this operation until the antenna property becomes satisfactory, the reflective surface curve is determined.

As described above, with the conventional parabola antennas, there is a problem that "the antenna property degrades as the diameter (aperture) of the main reflection mirror is set smaller." In this regard, the applicant of the present application has found that the above problem can be solved by forming the reflective surfaces of the main and sub reflection mirrors 11 and 12 as described above.

Then, the applicant of the present application has verified that side lobes which conventionally are about −14 db, respectively, can be improved to about −20 db by utilizing, for example, the main reflection mirror 11 built as described above.

In other words, with the antenna 10 of this embodiment, the aperture can be set small without degrading the antenna property. Moreover, since the antenna 10 of this embodiment has the configuration provided with the two reflection mirrors, compared to the configuration of Patent Document 1, the size thereof in the direction orthogonal to the aperture can also be reduced. Based on the above description, the antenna 10 having a configuration which is particularly suitable for a case of disposing a plurality of antennas 10 together (e.g., for meteorological observation) can be achieved.

As described above, this antenna 10 includes the power feeding waveguide 14, the sub reflection mirror 12, and the main reflection mirror 11. The radio waves comprised of the vertical and horizontal polarized waves are transmitted to the power feeding waveguide 14. The sub reflection mirror 12 is disposed to face the opening of the power feeding waveguide 14 and reflects the radio wave radiated from the opening of the power feeding waveguide 14. The main reflection mirror 11 is disposed to face the sub reflection mirror 12 and outwardly radiates the radio wave reflected on the sub reflection mirror 12. The front surface of the main reflection mirror 11 has the shape formed by rotating, around the rotational axis, the line reaching one side and the other side of the predetermined parabola curve at least once and extending along the parabola curve. The front surface of the sub reflection mirror 12 has the shape formed by rotating the stepped or wavy line around the rotational axis.

Thus, an antenna that is small in size as a whole and has satisfactory antenna property can be achieved.

Next, a modification of the above embodiment is described with reference to FIGS. 5(*a*)-(*c*). FIGS. 5(*a*)-(*c*) is a cross-sectional view illustrating the modification of the main and sub reflection mirrors 11 and 12.

Figure 5A:
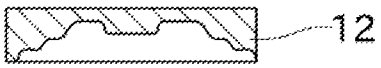
FIGS. 5(*a*)-(*c*) show cross-sectional views illustrating a modification of the main reflection mirror and a sub reflection mirror.

In the above embodiment, the reflective surface of the sub reflection mirror 12 has the shape formed by rotating the stepped line; however, alternatively, it may have a shape formed by rotating a wavy line (a line continuously changing in its inclination, a smooth line) as illustrated in FIG. 5(A). Moreover, the number of steps, height and the like of the stepped line are arbitrary and, for example, they may suitably be changed corresponding to the shape, a layout and the like of the reflective surface of the main reflection mirror 11.

Figure 5B:
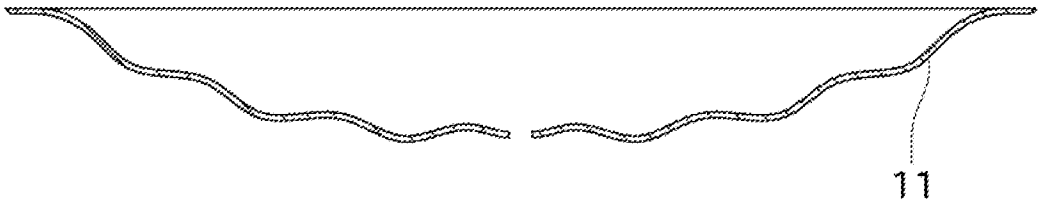
Figure 5C:
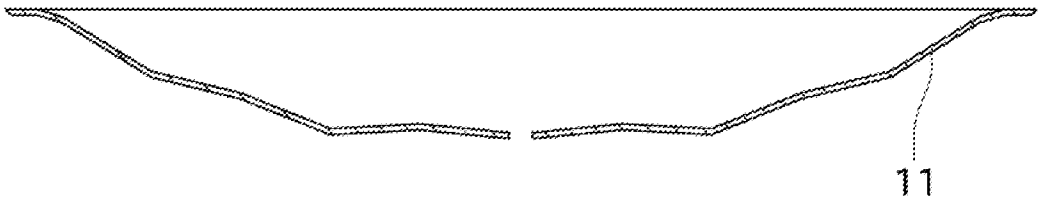

Moreover, the reflective surface of the main reflection mirror 11 may also be changed corresponding to the shape, a layout and the like of the reflective surface of the sub reflection mirror 12. For example, the number of times the reflective surface curve intersects with the parabola curve is arbitrary, and the reflective surface curve may match with the parabola curve or be inward or outward thereof at a closest position to the rotational axis. Moreover, as illustrated in FIG. 5(B), the reflective surface curve may be changed so that a finer wave surface (where the interval between the waving parts varies) appears. In this case, the reflective surface curve intersects with the parabola curve a larger number of times. Moreover, as illustrated in FIG. 5(C), it may be deformed to be formed by a plurality of inclined surfaces instead of a wave surface. This shape can be said as a shape formed by rotating, around the rotational axis, a line of which inclination changes discretely.

Although the preferred embodiment of this disclosure and the modification are described above, the above configurations may be modified as follows, for example.

The reflective surface curve of the main reflection mirror 11 may be determined by a suitable method without limiting to the above method. Moreover, the approximating method to be used is not limited to the multi-term approximation, and various approximating methods may be used.

The antenna 10 may have a configuration of being covered by a cover (radome) made of a material with high transmittance for radio waves.

DESCRIPTION OF REFERENCE NUMERAL(S)

1 Antenna Device
10 Antenna
11 Main Reflection Mirror
12 Sub Reflection Mirror
13 Sub Reflection Mirror Supporting Part
14 Power Feeding Waveguide

The invention claimed is:

1. An antenna, comprising:

a power feeding waveguide to which radio waves including a vertical polarized wave and a horizontal polarized wave are transmitted;

a sub reflection mirror disposed to face an opening of the power feeding waveguide and configured to reflect the radio waves radiated from the opening; and a main reflection mirror disposed to face the sub reflection mirror and configured to outwardly radiate the radio waves reflected by the sub reflection mirror, wherein a front surface of the main reflection mirror has a shape formed by rotating a line reaching one side and the other side of a predetermined parabola curve at least once, around a rotational axis, wherein a front surface of the sub reflection mirror has a shape formed by rotating a stepped line around the rotational axis, the stepped line being stair shaped and including a series of alternating and connected rise and run pairs, the rises being parallel to the rotational axis and extending from the runs toward the main reflection mirror, the runs being perpendicular to the rotational axis and extending radially outward, and wherein the rises are staggered at differing distances on the sub reflection mirror in a radially outward direction, such that a thickness between each rise and a radial edge of the sub reflection mirror in the radially outward direction is different for each rise on the sub reflection mirror.

2. The antenna of claim 1, wherein the front surface of the main reflection mirror has a shape formed by rotating a line intersecting with the predetermined parabola curve at least twice, around the rotational axis.

3. The antenna of claim 2, wherein the front surface of the main reflection mirror has a shape formed by rotating a line of which inclination changes continuously instead of discretely, around the rotational axis.

4. The antenna of claim 2, wherein the front surface of the sub reflection mirror has the shape formed by rotating the stepped line around the rotational axis.

5. The antenna of claim 2, wherein the antenna is used for observing a meteorological status.

6. The antenna of claim 1, wherein the front surface of the main reflection mirror has a shape formed by rotating a line of which inclination changes continuously instead of discretely, around the rotational axis.

7. The antenna of claim 6, wherein the front surface of the sub reflection mirror has the shape formed by rotating the stepped line around the rotational axis.

8. The antenna of claim 6, wherein the antenna is used for observing a meteorological status.

9. The antenna of claim 1, wherein the antenna is used for observing a meteorological status.

10. The antenna of claim 1, wherein the antenna is used for observing a meteorological status.

* * * * *